United States Patent [19]

Malacheski

[11] 4,011,636

[45] Mar. 15, 1977

[54] CLIP CONSTRUCTION

[76] Inventor: Joseph J. Malacheski, 130 E. Division St., Wilkes-Barre, Pa. 18702

[22] Filed: Mar. 12, 1976

[21] Appl. No.: 666,217

[52] U.S. Cl. ..... 24/137 R; 24/81 B; 24/81 CC; 24/81 FT; 24/259 FS; 24/259 GC; 24/84 B

[51] Int. Cl.[2] ..... A44B 21/00

[58] Field of Search ..... 24/67.11, 137, 73 FT, 24/81 B, 81 CC, 81 FT, 81 GS, 259 TF, 259 GC, 259 FS, 259 FF, 259 R, 255 VA, 255 TC, 255 R, 84 B; 16/16; 52/716; 211/119.12, 119.13; 5/353.2, 353.3; 160/403, 391, 394

[56] References Cited

UNITED STATES PATENTS

| | | | |
|---|---|---|---|
| 582,927 | 5/1897 | Johnson | 211/119.13 |
| 1,146,981 | 7/1915 | Weinberg | 211/119.12 |
| 2,064,591 | 12/1936 | David | 24/259 GC |
| 2,271,393 | 1/1942 | Fulton | 24/84 B |
| 2,527,674 | 10/1950 | Cold | 24/259 GC |
| 3,222,769 | 12/1965 | Leplae | 52/716 |
| 3,608,156 | 9/1971 | Ward | 24/81 B |

FOREIGN PATENTS OR APPLICATIONS

| | | | |
|---|---|---|---|
| 975,075 | 3/1951 | France | 52/716 |
| 430,862 | 6/1926 | Germany | 24/259 FF |
| 698,363 | 10/1953 | United Kingdom | 5/353.3 |

*Primary Examiner*—Bernard A. Gelak
*Attorney, Agent, or Firm*—Robert K. Youtie

[57] ABSTRACT

A clip construction including a back part for connection to a support, a resilient front part upstanding from a lower region of the back part and extending toward an intermediate region of the back part, and an entry lip outstanding from an upper region of the front part, for downward insertion of an article between the back part and entry lip into position between the back and front parts.

9 Claims, 5 Drawing Figures

FIG. 1
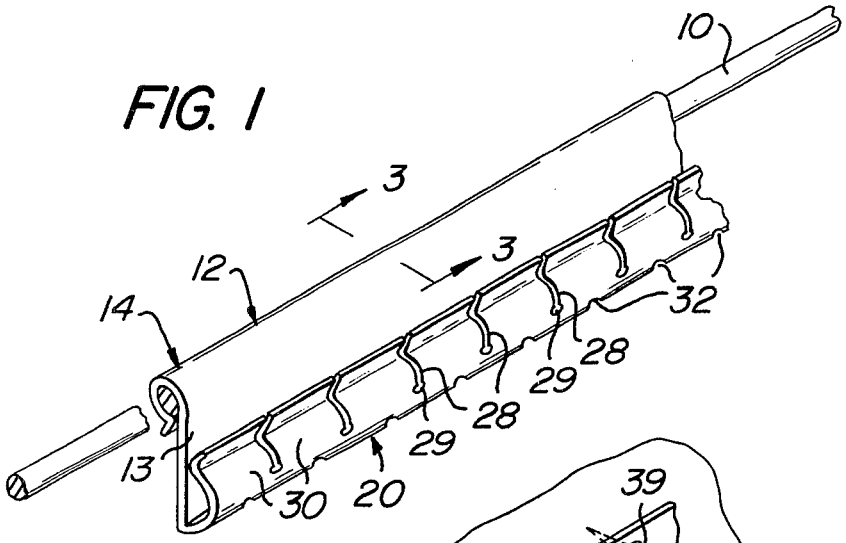
FIG. 2
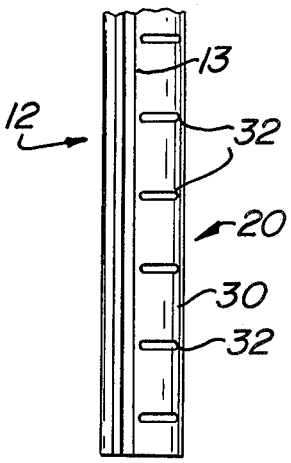
FIG. 4
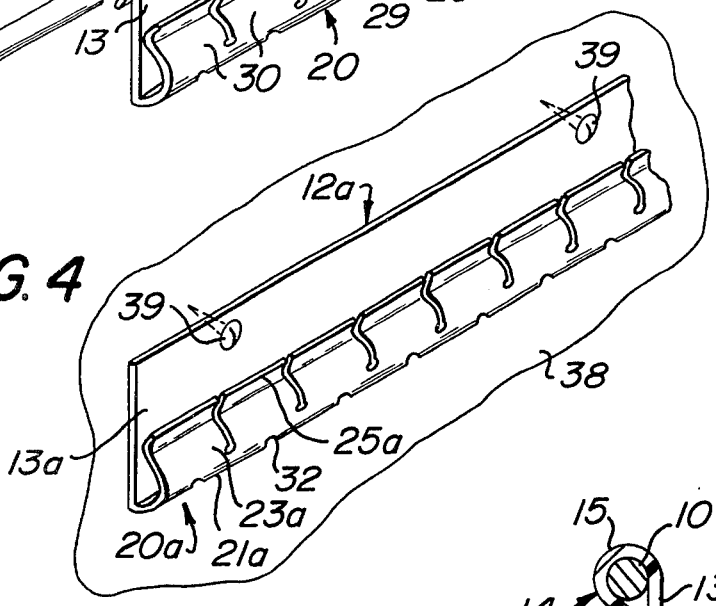
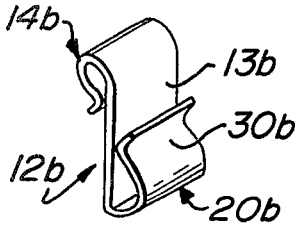
FIG. 5
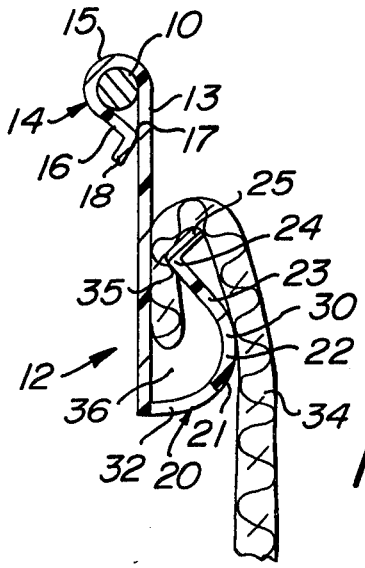
FIG. 3

CLIP CONSTRUCTION

BACKGROUND OF THE INVENTION

The present invention is illustrated and described hereinafter with particular reference to its use as a clothesline clip, but its use is not so limited, and all other applications are intended to be comprehended herein. In present clothesline clips or clothespins there are numerous disadvantages, including the frequent dropping and consequent losing of clothespins by their freedom from the clothesline, the necessity to store when not in use, the requirement for proper placement on the clothesline for each separate use, relative tedium and time-consuming procedures in holding articles on line and engaging clothespins thereover, as well as removal from and replacement in the storage container or bag, and the relative expense of prior art devices.

SUMMARY OF THE INVENTION

It is, therefore, an important object of the present invention to provide a clip construction which overcomes the above-mentioned difficulties, is self-storing on a clothesline to avoid the need for removal from and replacement in a storage container, being always in proper position on a clothesline for reception of articles to be hung, avoiding the frequent dropping, consequent bending and often loss of prior clothespins, greatly increasing the speed of clothes hanging and removal, and enhancing the aesthetic appeal of a clothesline, even when not in use.

It is a more particular object of the present invention to provide a clip construction having the advantageous characteristics mentioned in the preceding paragraph which is adapted for economic mass production and sale at substantial savings, substantial imperviousness to dirt and deterioration, which is constructed to effectively resist breakage while affording ease of flexibility requisite to use, and is admirably well suited for hanging both the heaviest types of articles as well as a multiplicity of small and light articles, without the need for different types of sizes of clothespins, avoids wrinkling of garments held and is adapted for use with various clothesline constructions, of different types, materials and sizes.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a clip construction of the present invention in operative association with a clothesline, broken away to conserve drawing space.

FIG. 2 is a bottom plan view of the clip construction of FIG. 1, apart from the clothesline.

FIG. 3 is a transverse sectional elevational view taken generally along the line 3—3 of FIG. 1, illustrating an article of clothing supported by the instant clip construction.

FIG. 4 is a top, front perspective view showing a slightly modified embodiment of clip construction of the present invention.

FIG. 5 is a top, front perspective view showing another embodiment of clip construction of the present invention.

DESCRIPTION OF THE PREFERRED EMBODIMENTS

Referring now more particularly to the drawings, and specifically to FIGS. 1–3 thereof, a clothesline is shown in FIG. 1 and there generally designated 10, which clothesline may be of any conventional construction, materials or size; and, of course, may be inside or outside, or permanent or removable. A clip construction of the present invention is generally designated 12, and is illustrated in position on the clothesline 10. The clip construction 12 may be integrally fabricated of a single piece of plastic material, as by extrusion or other plastic working material. Also, the instant clip may be fabricated of metal, say aluminum, if desired, but plastic is preferred.

The clip construction may be considered as of laterally elongate configuration, for extension along the clothesline 10, say of any suitable or desired length. In practice, the clip construction 12 may be of a standard lateral extension or length, say having 12 or 18 separate clip fingers, or may have lines of weakening, if desired, for separation into predetermined lengths and numbers of clip fingers. The multiple clip construction 12 includes a generally flat backing, wall or back part 13 which is adapted for connection or attachment to a suitable support. In the embodiment of FIG. 1, such support is a clothesline 10, and extending rearwardly from an upper region of the back part 13 is a mounting member or back loop 14 opening generally downwardly for receiving the clothesline 10. More specifically, the back loop 14 may include an upper portion 15 extending from an upper region of the back part or wall 13 generally rearwardly and downwardly, say in an arcuate configuration, and from the upper portion 15 there may extend a lower portion 16 generally downwardly and inwardly toward the back part 13. The back loop portion 16 may terminate proximate to or in abutting engagement with the back part or wall 13, as at 17, and an entry lip or flange may extend from the lower end of back loop region 16 generally downwardly and outwardly, as at 18, away from the rear surface of the back wall 13. By its inherent flexibility, the back loop 14 is openable upon rearwardly opening distention of the entry lip or flange 18 away from the back part or wall 13 for passage therethrough of the clothesline or cord 10. In the normal use condition, the clip construction 12 depends downwardly from the clothesline 10, the latter being received in the upper arcuate interior region of the back loop 14, so that the clip construction is always retained in proper orientation on the clothesline, as desired, and may be readily removed therefrom by mere upward movement of the clip construction to slide the clothesline 10 downwardly and distend the downwardly opening loop 14 for outward passage of the clothesline from the loop.

On the forward side of the back part or wall 13 is a clip front part, generally designated 20. The clip front part is integral with the back part or wall 13 and includes a lower region 21 extending from the lower edge of back part 13 generally forwardly and upwardly to a forwardmost crest or crown region 22. Extending upwardly and rearwardly from the crown region 22 is an upper region 23 of the front part 20, which terminates proximate to an intermediate region of the back wall 13 in a generally angulate engaging region 24. As illustrated, the clip construction front part 20 may be bowed forwardly, with its forwardmost crown region or crest 22 considerably spaced forwardly from the back part 13, while the engaging region 24 may, in the absence of external distention, abuttingly engage the front surface of back part 13 at a vertically intermediate region thereof. Projecting forwardly outwardly and obliquely upwardly from the engaging region 24 is an entry lip or flange 25 on the front part 20.

In practice, the several described parts, including the back part or wall 13, back supporting member or loop 14 and front part or loop 20 are all laterally coextensive with each other, and laterally extended so as to be of considerably greater lateral dimension than vertical height, as shown in FIG. 1.

In addition, the front part 20 is provided at a plurality of laterally spaced locations therealong with a plurality of cutouts, slots or openings, as at 28. Each opening 28 may extend downwardly or inwardly into the entry lip or flange 25 completely through the latter, thence continuing vertically downwardly through engaging part 24 and upper front loop region 23, terminating in an enlarged, generally circular hole 29 approximately along the crown or crest 22 of the front part. By this construction of cutouts or openings 28, defining slots extending from a closed end at circular opening 29 upwardly and opening outwardly through the upper edge of entry lip 25, the front part 20 is subdivided into a plurality of clip fingers 30, each being defined between an adjacent pair of cutouts or slots 28, and a slot 28 and the adjacent end of the front part. Thus, the clip fingers 30 are substantially independently resiliently distensible away from the back part or wall 13 to effectively provide separate clothes receiving and gripping clips. By termination of the cutouts or slots 28 at the crest 22 of arcuate front part 20, a substantial rigidity and strength is maintained for clothes gripping capacity while affording sufficient ease of distention for insertion of an article of clothing or the like. Viewed otherwise, the several clip fingers 30 are independently resiliently distensible away from the back part or wall 13, each being relatively easy to resiliently distend for insertion therebehind of an article of clothing. However, the article of clothing is held by the combined force of plurality of finger clips, so that relatively heavy articles may be supported without fear of falling. The circular enlarged configuration of each slot end or opening 29 serves to avoid or mininize any localized stresses or pressures caused by operating flexures, for greater durability under operating conditions.

In addition to the cutouts or openings 28, there are provided in the front part 20, at spaced locations along the lower region 21, a plurality of additional cutouts or openings 32. These cutouts may be of elongate, slot-like configuration each extending generally from the lower region of back part 13 in a generally vertical plane forwardly and upwardly to terminate at a location spaced below the crest 22 of front part 20. Further, the several lower cutouts, slots or openings 32 are preferably located in alternate spaced relation with respect to the upper cutouts or slots 28, as may be observed in FIG. 1. It will thus be understood that each lower cutout or slot 32 is located directly below a respective clip finger 30. The several lower cutouts or slots 32 afford quick and convenient drainage for removal of water or moisture being released from wet articles, as well as for removal of rain water, and self-cleaning of the clip construction 12.

As shown in FIG. 3, a flexible sheet 34, having appreciable thickness, such as a blanket or the like, is illustrated with one end region 35 entering downwardly between the back wall 13 and front part engaging region 24 into the space 36 between the back wall and front part. Thus, the blanket or other article is gripped between the engaging part 24 and back part 13, say substantially along its entire edge margin, and may extend smoothly upwardly and outwardly over the entry lip 25 and downwardly over the front part 20, so that the supported article is firmly and strongly suspended without undesired wrinkling, distortion or the like.

Referring now to the embodiment shown in FIG. 4, a clip construction is there generally designated **12*a*, and includes a generally vertical wall or back part 13*a* of considerable lateral extent, together with a laterally coextensive upwardly opening front part or loop 20*a*. The front part or loop 20*a* may be substantially identical to the first described front part or loop 20, including a forwardly bowed arcuate region 21*a*, 23*a* having an entry lip or flange 25*a* extending obliquely forwardly and upwardly from the upwardly opening front loop 20*a***.

The clip construction **12*a* differs from the first described embodiment in the absence of an upper support in the nature of a back loop, the back part or wall 13*a* being substantially flat on its rear surface for facing engagement with a generally vertical supporting surface 38, as by screws or other fasteners 39 projecting through the back part into the supporting wall. In this manner, the advantageous characteristics of the clip construction of FIGS. 1–3** may be employed as a fixed clip construction fastened to an upright supporting surface, rather than a clothesline.

The further embodiment of FIG. 5 shows a clip construction generally designated **12*b*, wherein is included an integral formation of generally upright wall or back part 13*b* having a rear loop 14*b* extending from an upper region of the back part, and a front loop 20*b* extending from a lower region of the back part. The back part 13*b*, rear supporting loop 14*b* and front part 20*b* may all correspond to the back part, rear loop and front part 13, 14 and 20 of the first described embodiment, except that the clip construction 12*b* is not laterally elongate, but is of considerably less and reduced lateral extent, being of greater vertical than lateral extent, if desired. Thus, the clip construction 12*b* may include only a single clip finger 30*b* rather than the multiple clip fingers 30 of the first described embodiment. Of course, the clip construction 12*b* may be used in similar manner to the hereinbefore described embodiments, except lacking in the considerable holding strength thereof. The laterally reduced clip 12*b* may be employed where greater ventilation is required to drying articles, greater than that afforded by the cutouts or openings 28 and 32** of the first described embodiment.

From the foregoing, it is seen that the clip construction of the present invention serves to effect considerable time savings in the hanging and retrieval of clothes, making the procedure simpler and easier, protects the clothesline from environmental elements, facilitates the hanging of rough, heavy articles, avoids loss of clothespins, encourages drying by hanging rather than energy consumption, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A clip construction comprising a generally upright back part for connection to a support, a resilient front part connected to and extending outwardly and upwardly from a lower region of said back part and thence inwardly and upwardly toward an intermediate region of said back part, and an entry lip connected to and extending outwardly from the upper end of said front part, for downward insertion of an article between said back part and entry lip intermediate said back and front parts with the latter deflected forwardly and its end in gripping engagement with said article, said back and front parts and entry lip extending laterally to define a laterally elongate overall configuration, and said front part and lip having a plurality of laterally spaced cutouts each extending downwardly through said lip and partially through said front part affording increased deflectability for ease of said article insertion.

2. A clip construction according to claim 1, in combination with a laterally elongate back loop on an upper region of and laterally coextensive with said back part for hanging engagement over a support.

3. A clip construction according to claim 2, said back loop extending rearwardly and downwardly from said back part.

4. A clip construction according to claim 1, said back and front parts and entry lip being an integral unit.

5. A clip construction according to claim 4, said front part having in its lower region a plurality of laterally spaced through openings for drainage.

6. A clip construction according to claim 1, said back loop extending downwardly and rearwardly from said back part and thence downwardly and forwardly toward said back part, and a downwardly facing lip on the lower end of said back loop for deflecting the latter outwardly to receive a clothesline or the like.

7. A clip construction according to claim 1, said cutouts each terminating in said front said remote from said back part for affording individual resilient deflectability to the front part portions between an adjacent pair of cutouts while maintaining the substantial resilient force.

8. A clip construction according to claim 1, said front part and entry lip meeting at an angle to define a rearwardly facing gripping edge for increased gripping engagement with an article.

9. A clip construction according to claim 4, said through openings and cutouts being arranged alternately to minimize weakening.

* * * * *